US005841347A

United States Patent [19]

Kim

[11] Patent Number: 5,841,347

[45] Date of Patent: Nov. 24, 1998

[54] ONE-TOUCH DOORLOCK DEVICE WITH FUNCTION OF OUTPUTTING SPEECH MESSAGE

[75] Inventor: Sung-Ki Kim, Ansan, Rep. of Korea

[73] Assignee: Duk Poong Mool San Co., Ltd., Seoul, Rep. of Korea

[21] Appl. No.: 697,006

[22] Filed: Aug. 16, 1996

[30] Foreign Application Priority Data

Aug. 16, 1995 [KR] Rep. of Korea ..... 1995 21109

[51] Int. Cl.[6] ..... E05B 45/06

[52] U.S. Cl. ..... 340/542; 70/278; 70/462; 340/692

[58] Field of Search ..... 340/542, 543, 340/692, 825.31; 361/172; 70/278, 279, 462

[56] References Cited

U.S. PATENT DOCUMENTS

| | | | |
|---|---|---|---|
| 4,184,349 | 1/1980 | Zaks | 70/118 |
| 4,798,065 | 1/1989 | DeForrest, Sr. | 70/462 X |
| 4,901,054 | 2/1990 | Waterman | 340/692 X |
| 5,419,167 | 5/1995 | Yamada et al. | 70/462 X |
| 5,475,996 | 12/1995 | Chen | 70/279 |
| 5,525,973 | 6/1996 | Andreou et al. | 70/278 X |

FOREIGN PATENT DOCUMENTS

| | | | |
|---|---|---|---|
| 2633653 | 1/1990 | France | 70/278 |

*Primary Examiner*—Thomas Mullen

*Attorney, Agent, or Firm*—Griffin, Butler, Whisenhunt & Szipl, LLP

[57] ABSTRACT

A one-touch doorlock device having a construction capable of being easily mounted at either a left or right side of a door by a simple manipulation, locking the door only by manipulating the doorknob without any additional manipulation, and outputting speech messages respectively corresponding to locked and unlocked states of the door by use of a microcomputer and a ROM as a speech memory stored with speech messages. The device thus provides easy and convenient doorlock mounting and provides convenience in use to the user. The doorlock device includes door locking mechanism for moving the locking bolt to its locked position. The door locking mechanism has a rotating member operatively connected to the doorknobs in such a manner that the rotating member rotates by a manipulation of the doorknobs, thereby moving the locking bolt between an extended position corresponding to the locked position and a retracted position. The doorlock device also includes lock releasing mechanism for rotating the rotating member in a direction such that the locking bolt moves to its retracted position. The lock releasing mechanism is activated by a signal output from a key input unit, and bolt direction switching mechanism for switching the manipulation direction of the doorknobs between left and right directions in accordance with a door opening direction.

10 Claims, 10 Drawing Sheets

ONE-TOUCH DOORLOCK DEVICE WITH FUNCTION OF OUTPUTTING SPEECH MESSAGE

BACKGROUND OF THE INVENTION

1. Field of the Invention

The present invention relates to a doorlock for locking a door, and more particularly to an one-touch doorlock device having a construction capable of being easily mounted at either a left or right side of the door, locking the door only by manipulating the doorknob without any additional manipulation, and outputting speech messages respectively corresponding to locked and unlocked states of the door.

2. Description of the Prior Art

Typically, doorlock devices include a primary latching bolt operatively connected to a doorknob used to open and close a door and a locking bolt activated by a mechanical key or electrical key signal. Since the latching bolt and locking bolt operate independently from each other, there is an inconvenience in that when it is desired to lock the door outdoors for an outing, a key must be used.

Conventional doorlock devices have different doorknob mounting directions depending on whether the door is constructed to be opened left or right. Furthermore, different doorlocks have been used respectively for doors constructed to be opened left and doors constructed to be opened right, due to problems associated with the structure operating the lock bolt.

For this reason, the user or assembler should select a desired doorlock device with full knowledge of the opening construction of the door to which the doorlock device will be mounted. If he prepares a doorlock device constructed to meet the opening direction reverse to that of the door to which the doorlock device will be mounted, the doorlock device is replaced by a suitable one. In particular, a doorlock device which has been appropriately used for a first door can not be used for another door having an opening direction reverse to that of the previous first door.

Conventional doorlock devices do not have a function of identifying the locked/unlocked state of the door. As a result, the user may apply overload to the doorlock device to open door in the locked state of the door while not sensing the locked state of the door. Consequently, conventional doorlock devices are frequently damaged or fail.

SUMMARY OF THE INVENTION

Therefore, an object of the invention is to provide a one-touch doorlock device having a construction capable of being easily mounted at either a left or right side of a door by a simple manipulation, locking the door only by manipulating the doorknob without any additional manipulation, and outputting speech messages respectively corresponding to locked and unlocked states of the door by use of a microcomputer and a read only memory (ROM) as a speech memory stored with speech messages, thereby achieving an easy and convenient doorlock mounting and providing convenience in use to the user.

In accordance with the present invention, this object is accomplished through an one-touch doorlock device comprising: a lock unit having a latching bolt and a locking bolt; a doorlock body provided with doorknobs having a common shaft to operate the latching bolt of the lock unit; door locking means for moving the locking bolt to its locked position, the door locking means having a rotating member operatively connected to the doorknobs in such a manner that the rotating member rotates by a manipulation of the doorknobs, thereby moving the locking bolt between its extended position corresponding to the locked position and its retracted position; lock releasing means for rotating the rotating member in such a direction that the locking bolt moves to its retracted position, the lock releasing means being activated by a signal output from a key input unit; a key unit for rotating the rotating member by a manipulation of a key selectively coupled to the key unit in such a direction that the locking bolt moves to its retracted position; bolt direction switching means for switching the manipulation direction of the doorknobs between left and right directions in accordance with a door opening direction; lock state sensing means for sensing a locked/unlocked state of the locking bolt; speech outputting means for outputting the sensed state of the locking bolt in the form of a speech signal; control means for controlling the lock releasing means and the speech outputting means, the control means including the key input unit; and power supply means for supply power to the lock releasing means, the speech outputting means and the control means.

BRIEF DESCRIPTION OF THE DRAWINGS

Other objects and aspects of the invention will become apparent from the following description of embodiments with reference to the accompanying drawings in which:

FIGS. 4A to 4C are partially-broken front views respectively illustrating different states of the doorlock device according to the present invention, wherein FIG. 4A shows the unlocked state of the locking bolt, FIG. 4B shows the locked state of the locking bolt, and FIG. 4C shows the unlocked state of the locking bolt;

FIGS. 5A to 5C are partially-broken front views respectively illustrating different states of the bolt state sensing means according to the present invention, wherein FIG. 5A shows the locked state of the locking bolt, FIG. 5B shows the unlocked state of the locking bolt, and FIG. 5C shows the state that the locking bolt is fixed in its unlocked state.

DETAILED DESCRIPTION OF THE PREFERRED EMBODIMENTS

Figure 1:
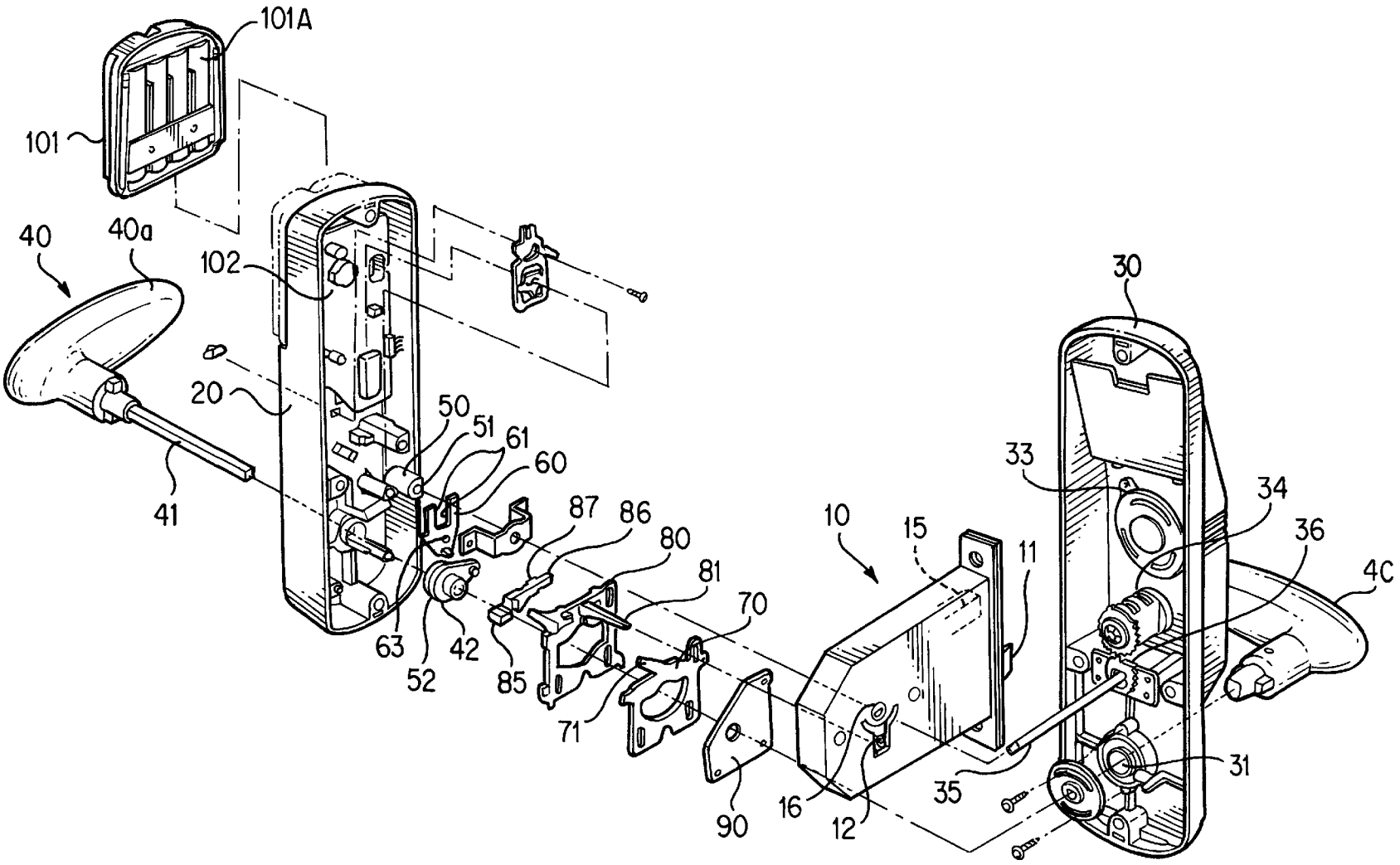
FIG. 1 is an exploded perspective view of a one-touch doorlock device in accordance with an embodiment of the present invention.

FIG. 1 illustrates an one-touch doorlock device in accordance with the present invention.

As shown in FIG. 1, the doorlock device includes a lock unit 10 having a latching bolt 11 and a locking bolt 15. The doorlock device also includes a doorlock body 23 which has an inner case 20 and an outer case 30. A battery case 101, containing batteries 101A, is detachably attached to an outer upper portion of the inner case 20. A circuit board 102 for button key means and speech outputting means is mounted on an inner upper portion of the inner case 20. Beneath the circuit board 102, the inner case 20 is provided with door locking means, lock releasing means, bolt state sensing means and doorlock direction switching means. The inner case 20 is also provided with a doorknob coupling hole 21. The outer case 30 is provided with a key input unit 32 (FIGS. 4–6), a speech generating speaker 33, a key unit 34 and a rotating shaft 35 gearing into the key unit 34. A key may be coupled to the key unit 34 to rotate the key unit 34. The outer case 30 is also provided with a doorknob coupling hole 31. The doorlock device further includes doorknobs 40 respectively coupled into the doorknob coupling holes 21 and 31 of the inner and outer cases 20 and 30. The doorknobs 40 serve to rotate a cam 42 fixedly mounted on a shaft 41 to which the door locking means, lock releasing means and doorlock direction switching means are operatively connected. The doorknobs 40 are also used to open the door.

The door locking means, which is mounted in the inner case 20 of the doorlock body 23, includes a pinion 50, a rack plate 60 provided with a pair of racks 61 disposed at both sides of the pinion 50 and selectively engaged with the pinion 50, and an assistant plate 70 adapted to move vertically in a selective manner in accordance with a guide operation (rotation) of the cam 42 fixedly mounted on a common shaft 41 of the doorknobs 40. The pinion 50 is fixedly mounted on the rotating shaft 35 which is coupled to a rotating member 16 for extending and retracting the locking bolt 15 of the lock unit 10. A gear 36 is fixedly mounted on the rotating shaft 35 and engaged with the key unit 34 mounted in the outer case 30 so that the rotating member 16 may be operatively connected to the key unit 34. The pinion 50 is provided with a gear 51 which has teeth on a 7/15 portion of its periphery. By this construction, the pinion 50 is engaged with a selected one of the racks 61 (the right rack 61 in the illustrated case) during its rotation, thereby vertically moving the rack plate 60. The assistant plate 70 is provided at its upper portion with a push member 71 serving to push up the rack plate 60.

The lock releasing means includes a moving plate 80 operatively connected to both the cam 42 and the latching bolt 11 of the lock unit 10, a solenoid 85 mounted on the upper rear surface of the moving plate 80 and activated by a signal generated from the key input unit 32, and an engaging pin member 86 mounted to the moving plate 80 and operatively connected to the solenoid 85 in such a manner that it moves laterally by the operation of the solenoid 85. The moving plate 80 moves vertically by a guide operation of the cam 42 coupled to the common shaft 41 of the doorknobs 40. The moving plate 80 has an outward protruded arm 81 which presses an elbow member 12 serving to extend and retract the latching bolt 11 of the lock unit 10. By this construction, the moving plate 80 can operate the latching bolt 11 as it moves by the guide operation of the cam 42. The engaging pin member 86 is provided at its rear surface with an engaging protrusion 87 which engages selectively with an engaging protrusion 62 provided at the rack plate 60 by the operation of the solenoid 85. In the state where the engaging protrusion 87 of the engaging pin member 86 engages with the engaging protrusion 62 of the rack plate 60, the engaging pin member 86 moves the rack plate 60 downward as the moving plate 80 moves downward. In this state, the pinion 50 engaged with the rack plate 60 rotates by the movement of the rack plate 60, thereby rotating the rotating member 16 of the lock unit 10 to release the locked state of the locking bolt 15.

The moving plate 80 is connected with the assistant plate 70 by means of tension coil springs 75 in such a manner that the moving plate 80 is always urged in an upward direction while the assistant plate 70 is always urged in a downward direction.

The elements of the door locking means and lock releasing means are supported in the inner case 20 by means of a support plate 90.

The bolt state sensing means includes a rotating cam 160 (FIG. 5) which is fixedly mounted on the rotating shaft 35 operatively connected to the key unit 34 to actuate the locking bolt 15. The rotating cam 160 is provided with a fixing protrusion 162, a guide portion 161 and a pushing protrusion 163. The bolt state sensing means also includes an actuating member 180 adapted to move vertically by a guide operation of the rotating cam 160.

The actuating member 180 is provided with a guide slot 181 in which a locking pin 170 is slidably received. The actuating member 180 also has a fixing hole 182 in which the fixing protrusion 162 is selectively engaged. A pair of switch members 183 are also provided at the actuating member 180 to activate a lock/unlock sensing switch 190 for sensing a locked/unlocked state of the locking bolt 15 and a cut-off switch 213 for maintaining the locking bolt 15 in its unlocked state, respectively.

Figure 2:
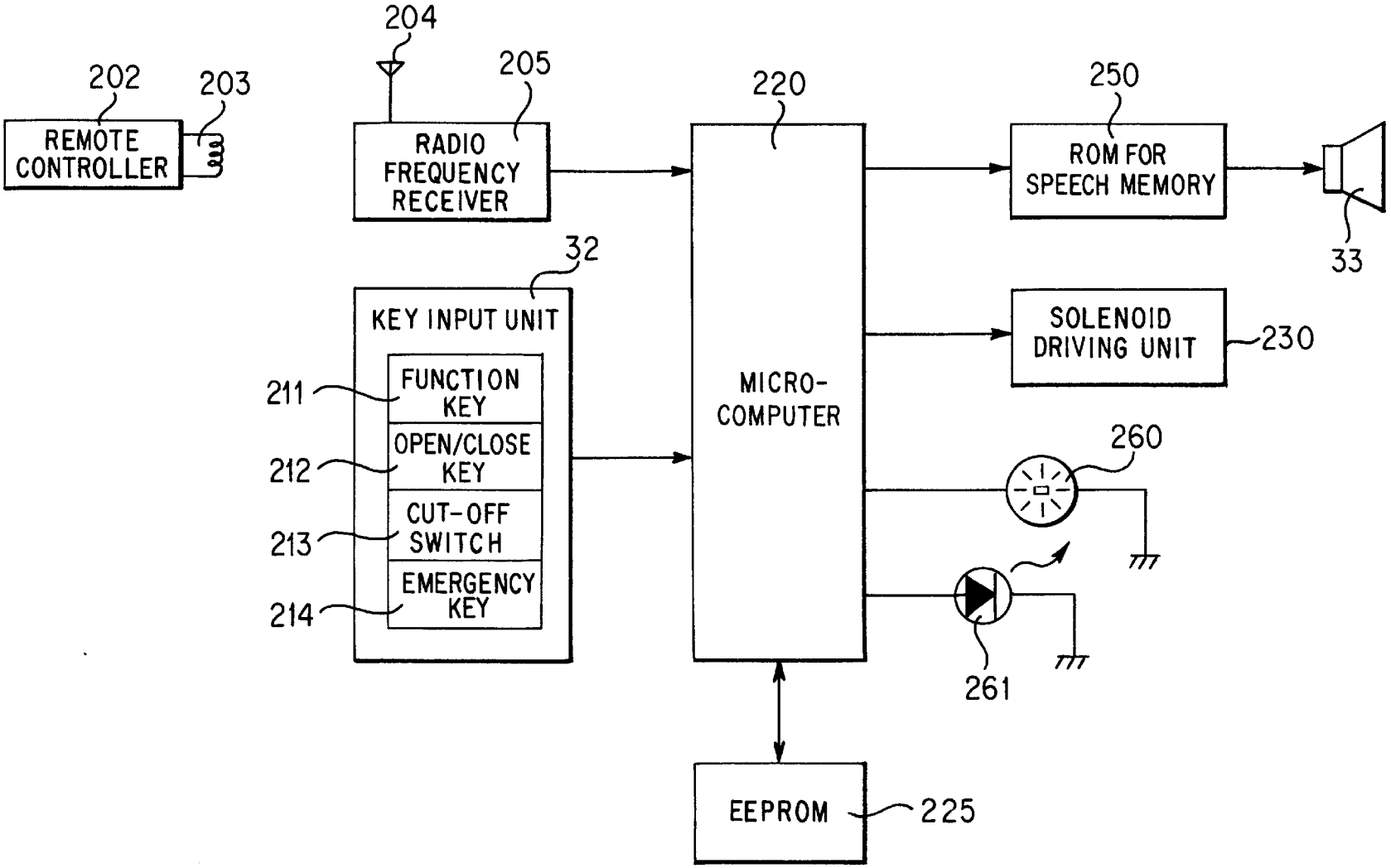
FIG. 2 is a block diagram illustrating the speech outputting means according to the present invention.

FIG. 2 is a block diagram illustrating the speech outputting means according to the present invention. As shown in FIG. 2, the speech outputting means includes a remote controller 202 for controlling the doorlock at a place remote from the doorlock. The remote controller 202 has a plurality of function keys for controlling locking and lock-releasing operations of the doorlock. The remote controller 202 generates a radio frequency corresponding to a key input.

The radio frequency generated from the remote controller 202 is transmitted via a pattern antenna 203 provided in the remote controller 202. The transmitted radio frequency is then received by a radio frequency receiver 205 via a radio receiving antenna 204 provided in the doorlock. The radio frequency is then demodulated and converted into a digital signal which is, in turn, sent to a microcomputer 220.

As shown in FIG. 2, the key input unit 32 includes a plurality of function keys 211 having the same functions as those of the keys of the remote controller 202, an open/close key 212 for opening and closing the doorlock, an emergency key 214 for unlocking the doorlock in an emergency situation, and the cut-off switch 213. The key input unit 32 sends data associated with a key input to the microcomputer 220.

An EEPROM 225 is coupled to the microcomputer 220. The EEPROM 225 stores therein a secret number which is set and input by the key input unit 32. The inputting/outputting of the secret number is controlled by the microcomputer 220.

A solenoid driving unit 230 is also connected to the microcomputer 220. The solenoid driving unit 230 serves to selectively activate the solenoid 85 (FIG. 1) for locking or unlocking the doorlock in accordance with a control signal from the microcomputer 220.

A ROM 250 as a speech memory is also coupled to the microcomputer 220 to audibly inform the user of the control state of the microcomputer 220. The ROM 250 outputs a speech message corresponding to an operation of the microcomputer 220 via a speaker 33.

A buzzer 260 is also coupled to the microcomputer 220 to generate a sound corresponding to the operation of the microcomputer 220. In order to display the operation of the microcomputer 220, a light emitting diode 261 is also connected to the microcomputer 220.

Figure 3:
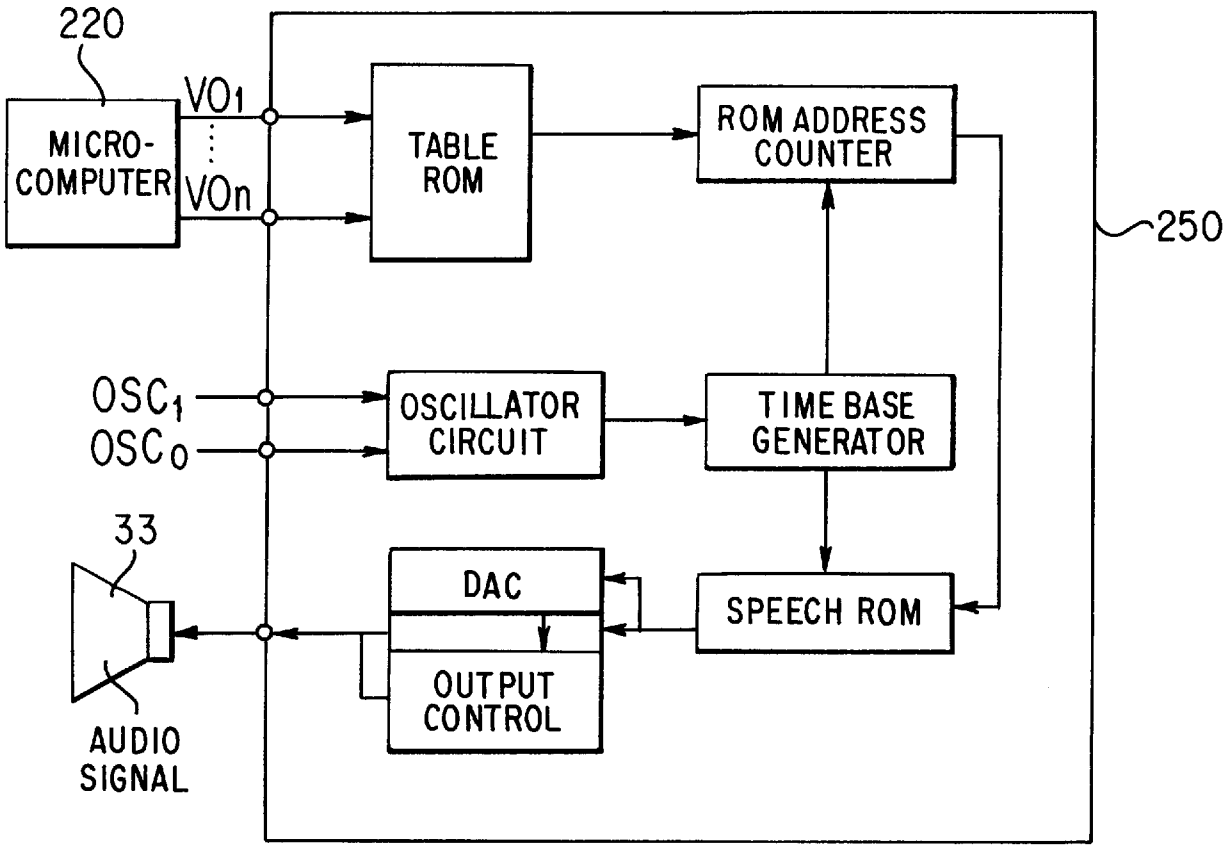
FIG. 3 is a block diagram illustrating the ROM as a speech memory according to the present invention.

As shown in FIG. 3, the ROM 250 includes a table ROM for calculating a speech message from those stored in the ROM under a control of the microcomputer, an oscillator circuit unit for externally receiving a crystal frequency and generating a frequency for driving the ROM based on the received crystal frequency, a time base generator for generating clock pulses in accordance with the frequency from the oscillator circuit unit, and a ROM address counter for receiving the message output from the table ROM and outputting speech data in accordance with the clock pulses output from the time base generator. The ROM 250 also includes a speech ROM for receiving the speech data from the ROM address counter and outputting the received speech data in the form of a digital signal in accordance with the clock pulses output from the time base generator, a digital/analog converter for converting the digital signal output from the speech ROM into an analog signal, and an output control unit for outputting the analog signal from the digital/analog converter in the form of an audio signal to be subsequently reproduced in the form of speech by the speaker 33.

Now, the operation of the one-touch doorlock device will be described in detail.

Figure 4A:
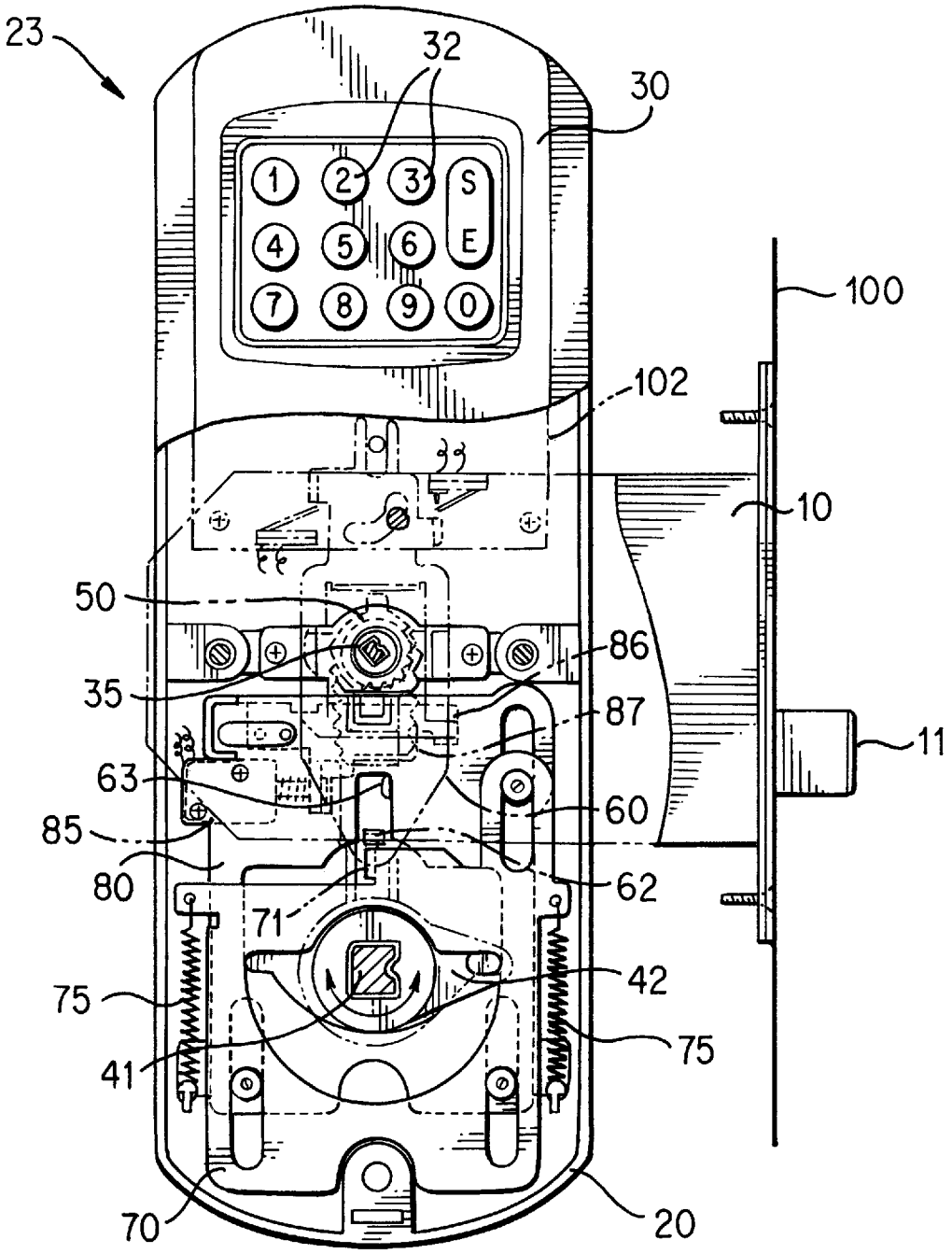
Figure 4:
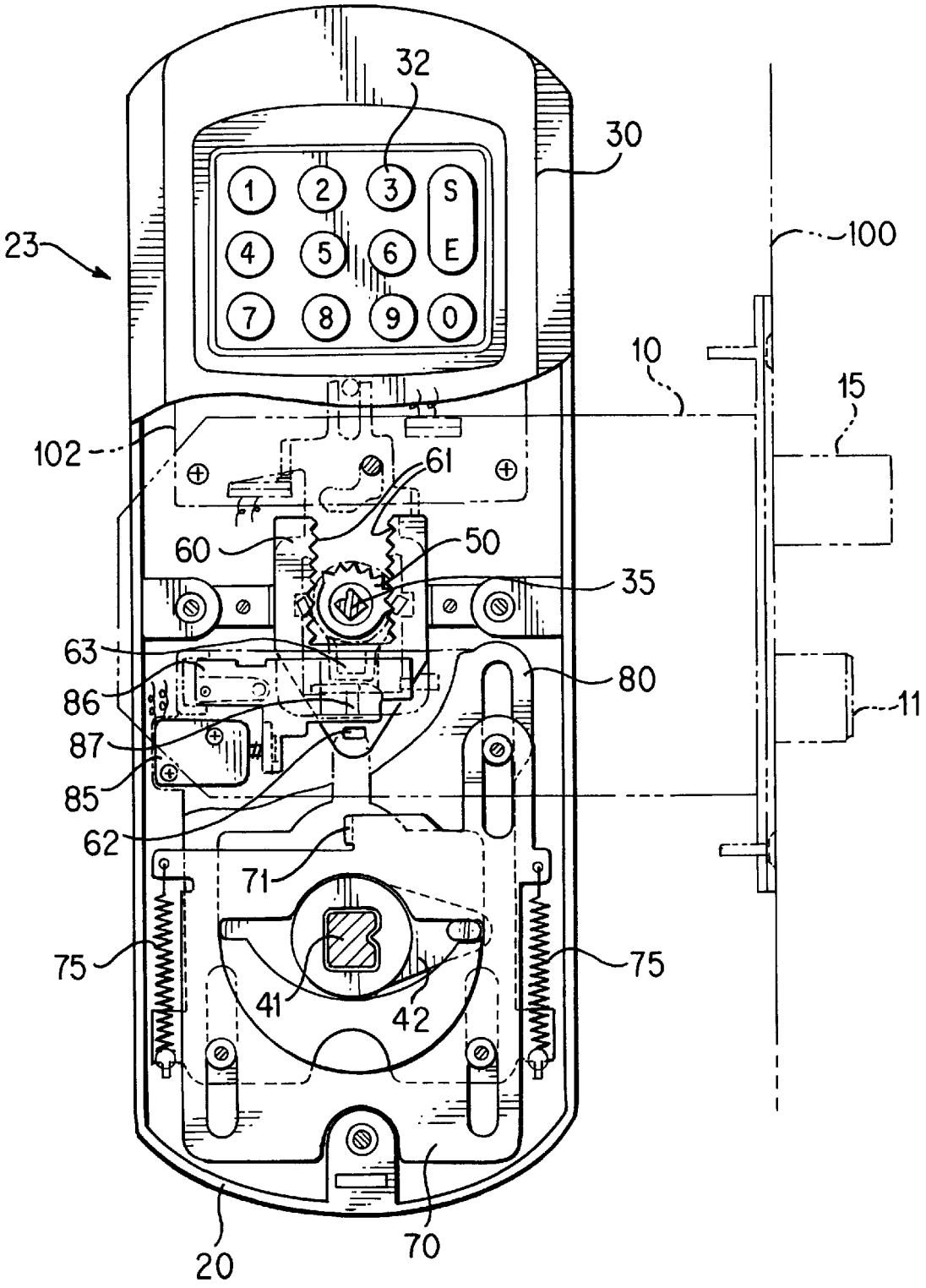
Figure 4C:
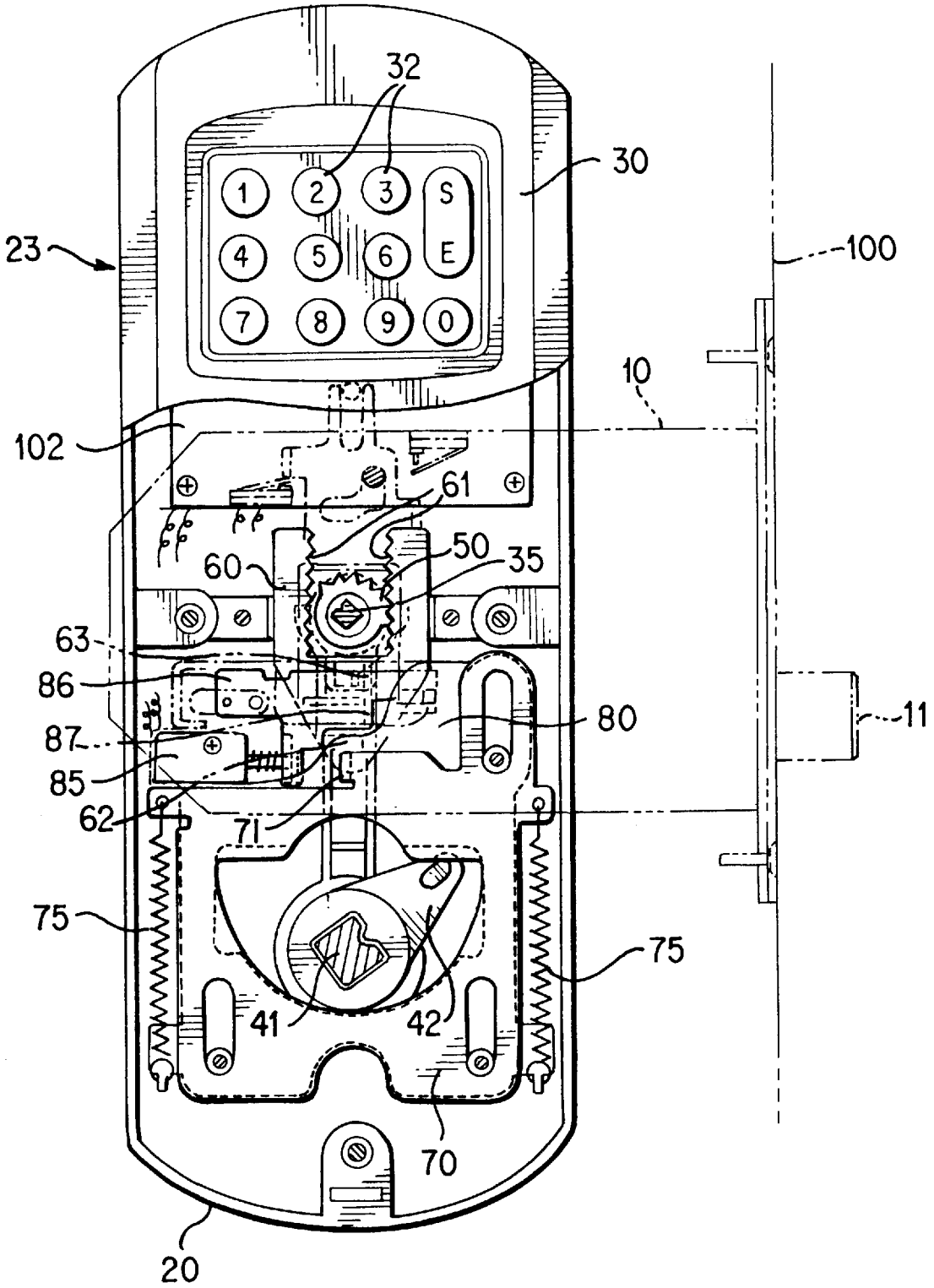

In the state of FIG. 4A, the rack plate 60 is maintained at its lowest position. At this time, the solenoid 85 mounted on the upper portion of the moving plate 80 is in its activated state, thereby causing the engaging pin member 86 to be maintained at its right position. At the right position of the engaging pin member 86, the engaging protrusion 87 of the engaging pin member 86 is spaced from the engaging protrusion 62 of the rack plate 60. In this state, the engaging pin member 86 and the rack plate 60 do not interfere with each other.

When one of the doorknobs 40 rotates in clockwise in such a manner that its free end 40*a* (FIG. 1) extends downward, the cam 42 fixedly mounted on the common shaft 41 of the doorknob 40 rotates clockwise, thereby moving the assistant plate 70 downward along with the moving plate 80 connected to the assistant plate 70 via the tension coil springs 75. By the downward movement of the moving plate 80, the arm 81 (FIG. 1) of the moving plate 80 presses down the elbow member 12 coupled to the latching bolt 11 of the lock unit 10, so that the latching bolt 11 may move to its retracted position at which the latching of the latching bolt 11 is released. In this state, accordingly, the door 100 can be opened.

When it is desired to lock the door 100 in the above-mentioned state, this locking operation can be achieved by simply rotating the doorknob 40 (FIG. 1) in a direction reverse to that of the above-mentioned case without using any key. That is, when the doorknob 40 rotates reversely, namely, in counterclockwise, the cam 42 rotates in counter-clockwise as shown in FIG. 4B, thereby causing the assistant plate 70 to move upward along with the moving plate 80. As a result, the push member 71 of the assistant plate 70 comes into contact with the lower end of the rack plate 60 and pushes the rack plate 60 upward.

As the rack plate 60 moves upward, the pinion 50 engaged with the right rack 61 rotates in counter-clockwise, so that the rotating member 16 (FIG. 1) of the lock unit 10 may rotate to move the locking bolt 15 to its extended position. As a result, the door 100 is locked.

Figure 5A:
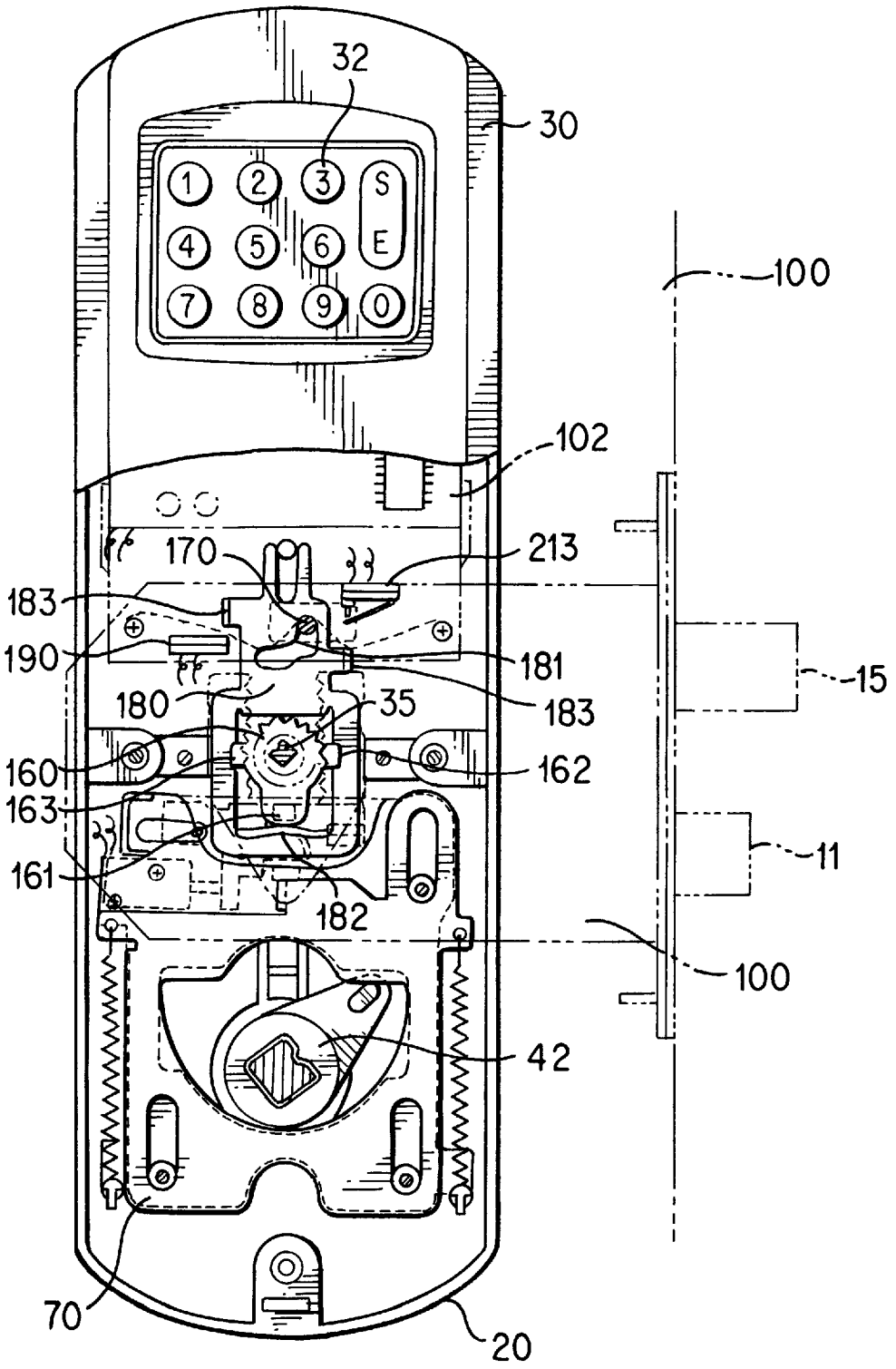
Figure 6:
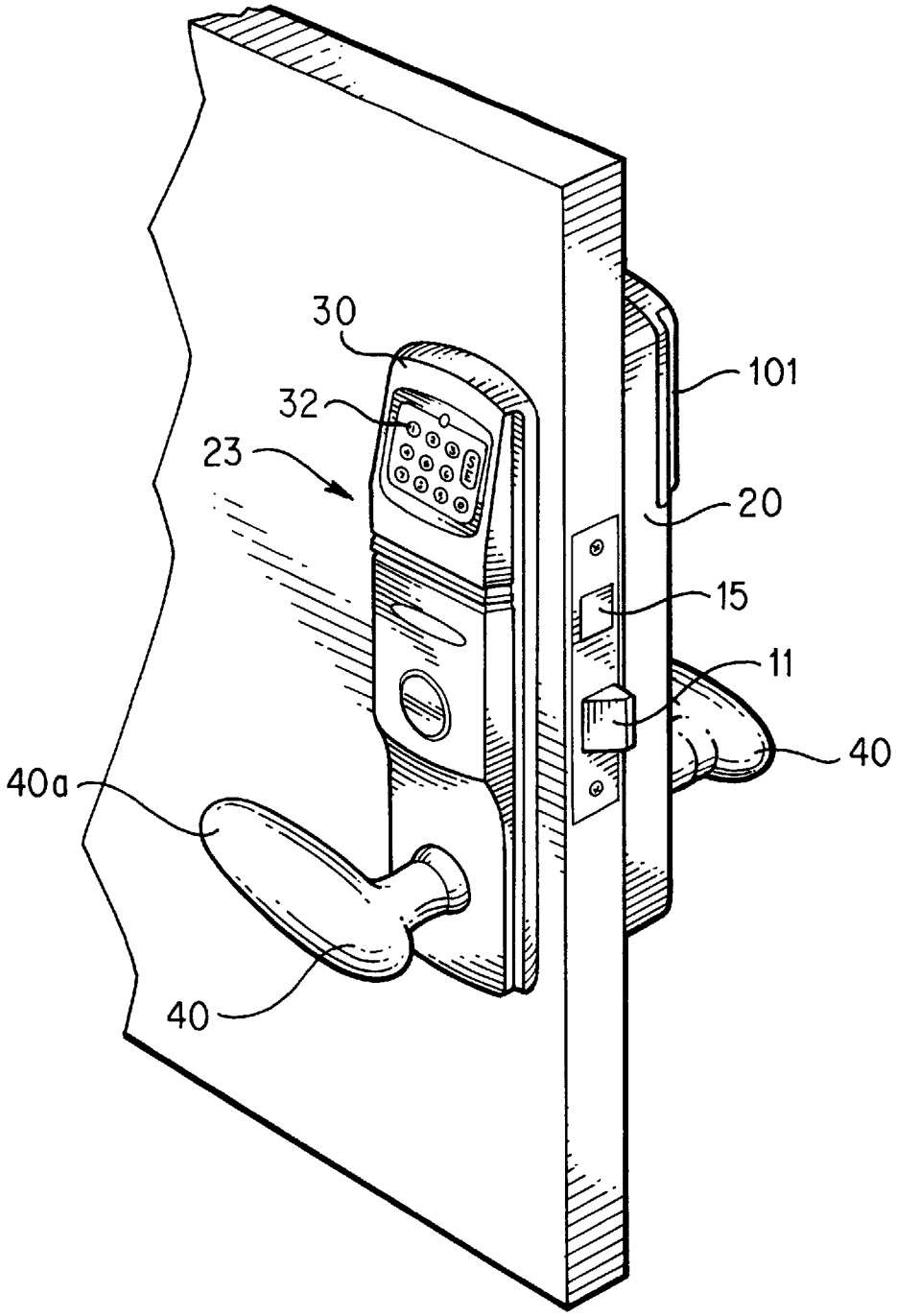
FIG. 6 is a perspective view illustrating the doorlock device according to the present invention in use.

At this time, the actuating member 180 of the bolt state sensing means moves to its lowest position by the guide portion 162 of the rotating cam 160, as shown in FIG. 5A. At the lowest position of the actuating member 180, the switch member 183 associated with the lock sensing switch 213 (FIG. 2) comes into contact with the lock sensing switch 213 which is, in turn, switched to its ON state. Accordingly, the extended state of the locking bolt 15, namely, the locked state of the door, is displayed.

At this time, the microcomputer 220 outputs a speech message "Locked" stored in the ROM 250 as a speech memory.

In this state, the door 100 maintains its locked state even though the doorknob 40 (FIG. 1) rotates in clockwise. This is because the engaging protrusion 87 (FIG. 1) of the engaging pin member 86 is spaced from the engaging protrusion 62 of the rack plate 60 so that the engaging pin member 86 and the rack plate 60 may not interfere with each other.

When it is desired to release the locked state of the door 100, it is required to rotate the key unit 34 (FIG. 1) using a key, thereby causing the locking bolt 15 to move to its retracted position. Alternatively, the solenoid 85 mounted on the upper portion of the moving plate 80 is activated by a control signal generated by manipulating the key input unit 32 or remote controller 202 (FIG. 2). When the solenoid 85 is activated, it moves the engaging pin member 86 to its left position where the engaging protrusion 87 of the engaging pin member 86 is vertically aligned with the engaging protrusion 62 of the rack plate 60. When the doorknob 40 (FIG. 1) rotates clockwise in this state, the cam 42 rotates clockwise, thereby moving the moving plate 80 downward. By the downward movement of the moving plate 80, the rack plate 60 moves downward as the engaging protrusion 87 of the engaging pin member 86 pushes down the engaging protrusion 62 of the rack plate 60. As a result, the pinion 50 engaged with the right rack 61 of the rack plate 60 rotates in clockwise, thereby causing the rotating member 16 of the lock unit 10 to rotate in clockwise. By the clockwise rotation of the rotating member 16, the locking bolt 15 moves to its retracted position. At the same time, the arm 81 of the moving plate 80 presses down the elbow member 12 coupled to the latching bolt 11 of the lock unit 10, so that the latching bolt 11 may move to its retracted position. In this state, accordingly, the door 100 can be opened.

Figure 5B:
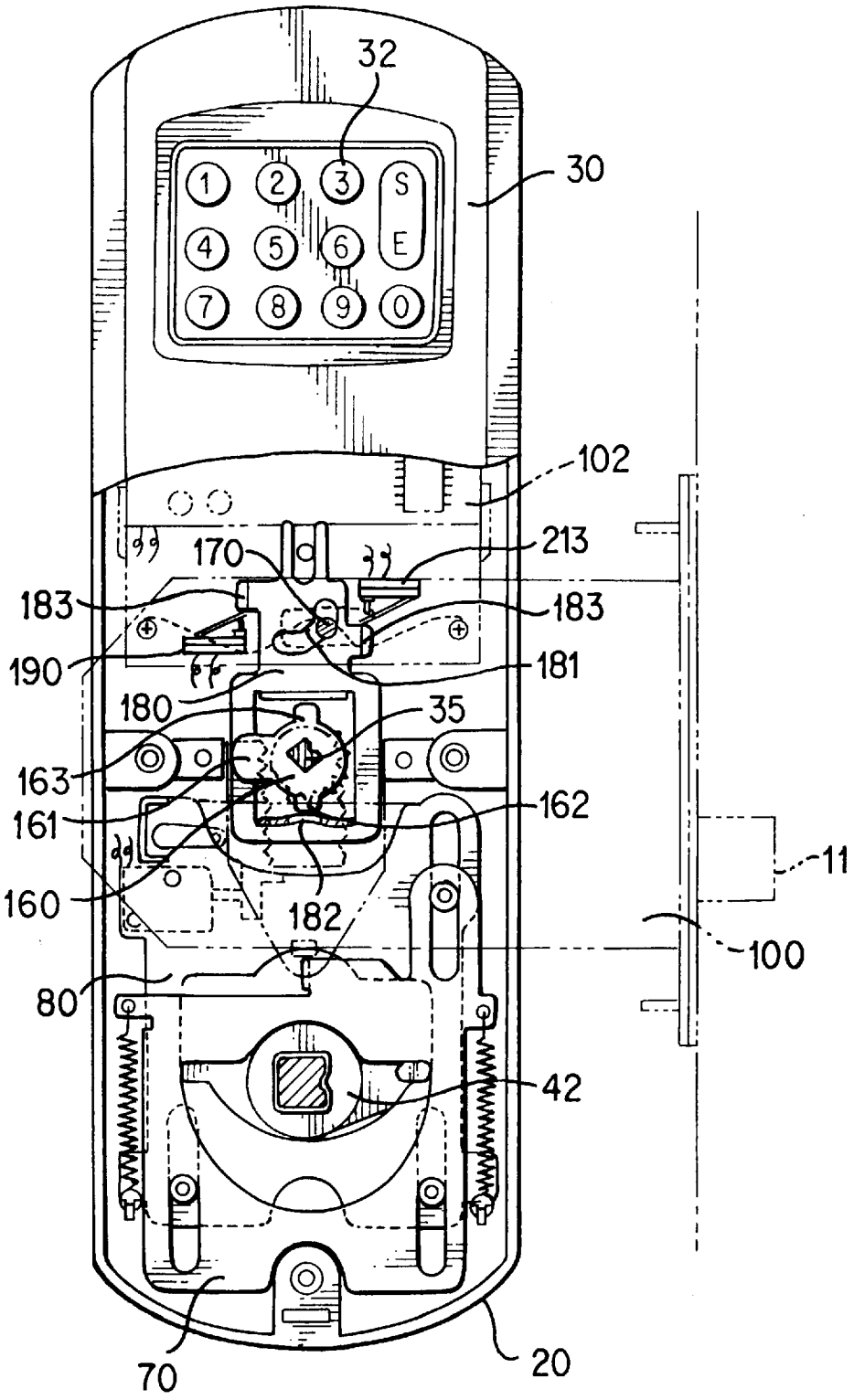

When the doorknob 40 rotates to move the locking bolt 15 to its retracted position releasing the locked state of the locking bolt 15, the rotating shaft 35 operatively connected to the locking bolt 15 rotates, thereby rotating the rotating cam 160. As the rotating cam 160 rotates, the guide portion 161 of the rotating cam 160 disengages from the lower end of the actuating member 180 while the protruded portion 163 of the rotating cam 160 comes into contact with the actuating member 180, thereby pushing up the actuating member 180, as shown in FIG. 5B. In this state, the switch member 183 associated with the lock/unlock sensing switch 190 is separated from the lock/unlock sensing switch 190 which is, in turn, switched to its OFF state. Accordingly, the retracted state of the locking bolt 15, namely, the unlocked state of the door, is displayed. At this time, the locking pin 170 is positioned at the right lower position of the guide slot 181.

When the speech outputting means receives an open/close key signal from the remote controller 202 (FIG. 2) via the radio receiving antenna 204, its radio frequency receiver 205 demodulates the received radio frequency, thereby converting it into a binary code which is, in turn, sent to the microcomputer 220. Based on the received signal, the microcomputer 220 determines the secret number stored in the EEPROM 225 in accordance with a program stored in the microcomputer 220, thereby controlling the solenoid 85.

When the locked state of the locking bolt 15 is released as mentioned above, the microcomputer 220 outputs a speech message corresponding to the operation state of the doorlock. That is, the microcomputer 220 outputs a speech message "Unlocked" stored in the ROM 250 as a speech memory.

When the doorknob 40 returns to its original position from the unlocked state of the door 100, the moving plate 80 moves upwardly by virtue of the resilience of the tension coil spring 75. As the moving plate 80 moves upwardly, the engaging protrusion 87 of the engaging pin member 86 comes into contact with the engaging protrusion 63 of the rack plate 60, thereby causing the engaging pin member 86 to move to its left position. By this movement of the engaging pin member 86, the solenoid 85 is activated, thereby completely moving the engaging pin member 86 to its right position. As a result, the engaging protrusion 87 of the engaging pin member 86 is spaced from the engaging protrusion 62 of the rack plate 60 so that the engaging pin member 86 and the rack plate 60 may not interfere with each other. Accordingly, the engaging pin member 86 does not interfere with a rotation of the doorknob 40.

Figure 5C:
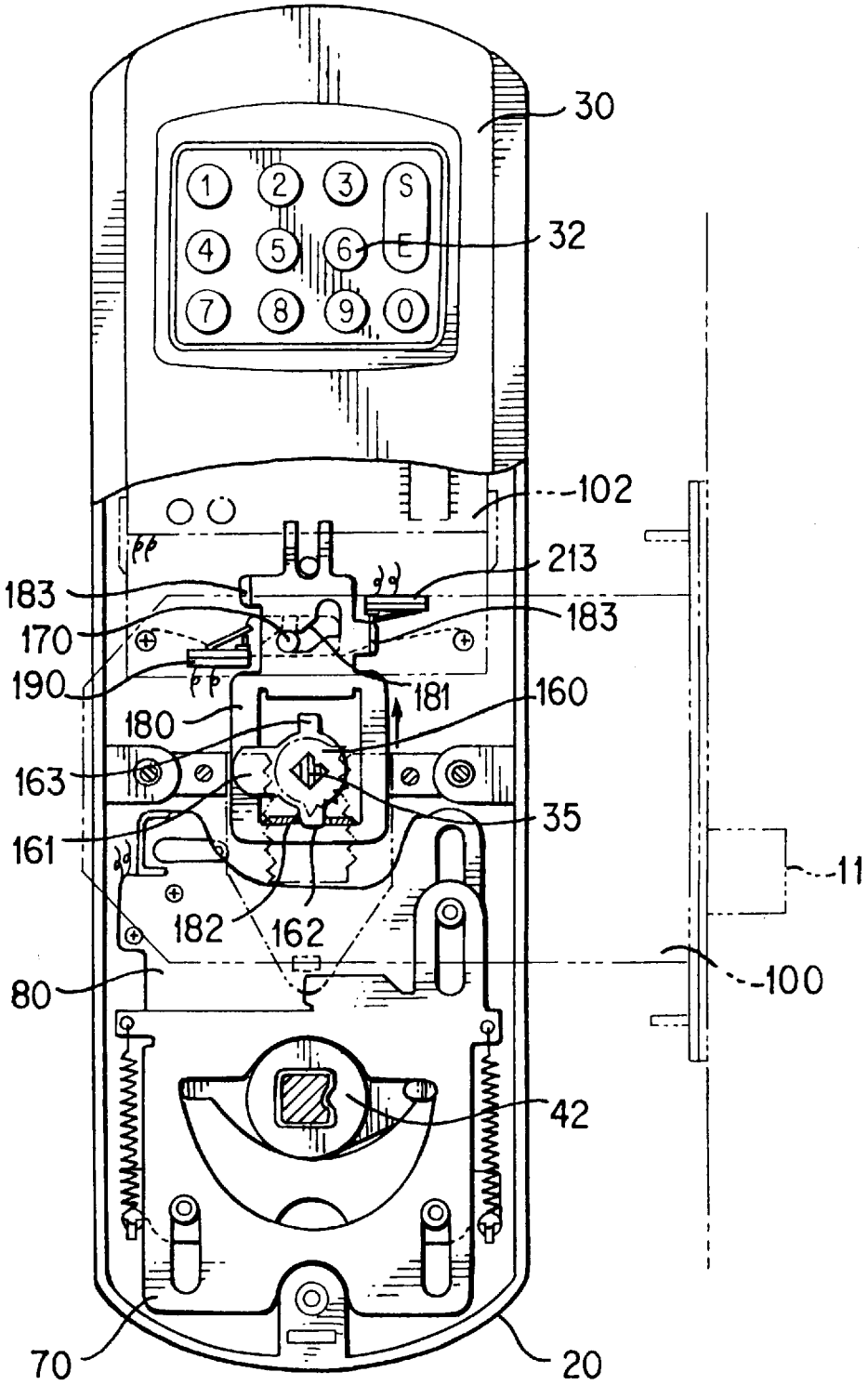

If it is desired to continuously maintain the unlocked state of the doorlock, the locking pin 170 then moves to its left position as shown in FIG. 5C. By this movement of the locking pin 170, the actuating member 180 is guided by the locking pin 170 to move upward. As the actuating member 180 moves upward, the switch member 183 associated with the cut-off switch 213 comes into contact with the cut-off switch 213 which is, in turn, switched to its ON state. In the ON state of the cut-off switch 213, the operations of the microcomputer 220 and key input unit 32 are stopped. In this state, the fixing protrusion 162 of the rotating cam 160 is engaged in the fixing hole 182 of the actuating member 180, thereby preventing the rotating shaft 35 from rotating. Accordingly, the locking bolt 15 is fixed in its unlocked state.

In the illustrated embodiment of the present invention, the doorknobs are set in such a manner that when they rotate in clockwise, the door can be opened. In this case, locking of the doorlock is achieved by extending or protruding the latching bolt 11 and locking bolt 15 of the lock unit 10 in a right direction. Where it is desired to achieve locking of the doorlock by protruding the latching bolt 11 and locking bolt 15 of the lock unit 10 in a left direction, that is, where the opening direction of the door 100 is reverse to the above-mentioned case, the lock unit 10 is assembled in a horizontally inverted state. In this case, the pinion 50 is mounted in an inverted state on the rotating shaft 35 of the lock unit 10 so that it can engage with the left rack 61 of the rack plate 60. In this case, one of the doorknobs 40 is re-coupled to the doorlock body 23 after being slightly separated from the doorlock body 23 and then rotating through an angle of 180° in counter-clockwise. By the 180° rotation of the doorknob 40, the cam 42 coupled to the common shaft 41 of the doorknob 40 rotates 180° in such a manner that its cam portion is positioned left. In this state, the same functions as those in the above-mentioned case are obtained when the doorknob 40 is reversely manipulated.

As apparent from the above description, the present invention provides an one-touch doorlock device having a construction capable of not only locking the doorlock by simply rotating the doorknob, but also releasing the locked state of the doorlock in association with a key input unit. The one-touch doorlock device can be easily applied to doors having different opening directions by changing the mounting direction of its lock unit to left or right by a simple manipulation. Since the doorlock device of the present invention includes speech outputting means, there is a convenience in use in that the locked/unlocked state of the door is audibly informed. The doorlock device of the present invention also includes bolt state sensing means which accurately transmits the state of the locking bolt to a microcomputer or other functioning means. Accordingly, it is possible to eliminate factors generating a failure caused by a possible malfunction of the doorlock.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An one-touch doorlock device comprising:

a lock unit having a latching bolt and a locking bolt;

a doorlock body provided with doorknobs having a common shaft to operate the latching bolt of the lock unit;

door locking means for moving the locking bolt to its locked position, the door locking means having a rotating member operatively connected to the doorknobs in such a manner that the rotating member rotates by a manipulation of the doorknobs, thereby moving the locking bolt between its extended position corresponding to the locked position and its retracted position;

lock releasing means for rotating the rotating member in such a direction that the locking bolt moves to its retracted position, the lock releasing means being activated by a signal output from a key input unit;

a key unit for rotating the rotating member by a manipulation of a key selectively coupled to the key unit in such a direction that the locking bolt moves to its retracted position;

bolt direction switching means for switching the manipulation direction of the doorknobs between left and right directions in accordance with a door opening direction;

lock state sensing means for sensing a locked/unlocked state of the locking bolt;

speech outputting means for outputting the sensed state of the locking bolt in the form of a speech signal;

control means for controlling the lock releasing means and the speech outputting means, the control means including the key input unit; and power supply means for supplying power to the lock releasing means, the speech outputting means and the control means.

2. The one-touch doorlock device in accordance with claim 1, wherein the door locking means comprises:

a pinion fixedly mounted on a rotating shaft coupled to the rotating member for extending and retracting the locking bolt of the lock unit, the pinion rotating by a manipulation of the key;

a rack plate provided with a pair of racks disposed at both sides of the pinion and selectively engaged with the pinion, the rack plate moving vertically by a rotation of the pinion;

a cam fixedly mounted on a common shaft of the doorknobs to rotate by a manipulation of the doorknobs; and an assistant plate adapted to move vertically in a selective manner in accordance with the rotation of the cam, thereby vertically moving the rack plate.

3. The one-touch doorlock device in accordance with claim 2, wherein the lock releasing means comprises:

a moving plate operatively connected to both the cam of the door locking means and the latching bolt of the lock unit, the moving plate moving vertically by a guide operation of the cam to move the latching bolt between its extended position and its retracted position;

a solenoid mounted on the moving plate and activated by a signal generated from the key input unit; and an engaging pin member mounted to the moving plate and operatively connected to the solenoid in such a manner that the engaging pin member moves laterally by an operation of the solenoid to a position where the engaging pin member engages with the rack plate of the door locking means, so that the rack plate can move downward by a downward movement of the moving plate.

4. The one-touch doorlock device in accordance with claim 3, wherein the moving plate and the assistant plate are coupled to each other by tension coil springs each having opposite ends respectively coupled to the moving plate and the assistant plate in such a manner that the moving plate is always urged in an upward direction while the assistant plate is always urged in a downward direction.

5. The one-touch doorlock device in accordance with claim 1, wherein the bolt direction switching means comprises:

a pinion operatively connected to the rotating member, the pinion having teeth on a 7/15 portion of its periphery;

a rack plate provided with a pair of racks disposed at both sides of the pinion and selectively engaged with the pinion;

a cam fixedly mounted on a common shaft of the doorknobs to rotate by a manipulation of the doorknobs, the cam having two cam positions spaced 180° from each other;

an assistant plate adapted to move vertically in a selective manner in accordance with the rotation of the cam, thereby vertically moving the rack plate; and a moving plate operatively connected to both the assistant plate and the latching bolt of the lock unit, so that the moving plate can move vertically by a guide operation of the cam to move the latching bolt between its extended position and its retracted position.

6. The one-touch doorlock device in accordance with claim 1, wherein the power supply means comprises:

a plurality of batteries; and a battery case for receiving the batteries therein, the battery case being separably coupled to a doorlock body.

7. The one-touch doorlock device in accordance with claim 1, wherein the control means comprises:

a remote controller for controlling the lock releasing means at a place remote from the doorknobs, the remote controller having a plurality of function keys;

a radio frequency receiver for receiving a radio frequency signal from the remote controller and converting the received radio frequency signal into a digital signal;

the key input unit for controlling the lock releasing means, the key input unit having the same function keys as the remote controller;

a microcomputer for receiving a signal output from either the radio frequency receiver or the key input unit and outputting a control signal based on the received signal; and an EEPROM for storing a secret number output from either the remote controller or the key input unit and outputting the stored secret number to the microcomputer;

a solenoid driving unit for driving a solenoid included in the lock releasing means; and a light emitting diode for emitting light under a control of the microcomputer.

8. The one-touch doorlock device in accordance with claim 1, wherein the speech outputting means comprises:

a ROM as a speech memory for outputting speech data indicative of the current state of the doorlock device under a control of the microcomputer;

a speaker for amplifying the output signal from the ROM and outputting the amplified signal; and a buzzer for outputting a sound indicative of the current state of the doorlock device under a control of the microcomputer.

9. The one-touch doorlock device in accordance with claim 8, wherein the ROM as a speech memory comprises:

a table ROM for calculating a speech message from those stored in the ROM under a control of the microcomputer;

an oscillator circuit unit for externally receiving a crystal frequency and generating a frequency for driving the ROM based on the received crystal frequency;

a time base generator for generating clock pulses in accordance with the frequency from the oscillator circuit unit;

a ROM address counter for receiving the message output from the table ROM and outputting speech data in accordance with the clock pulses output from the time base generator;

a speech ROM for receiving the speech data from the ROM address counter and outputting the received speech data in the form of a digital signal in accordance with the clock pulses output from the time base generator;

a digital/analog converter for converting the digital signal output from the speech ROM into an analog signal; and an output control unit for outputting the analog signal from the digital/analog converter in the form of an audio signal to be subsequently reproduced in the form of speech by a speaker.

10. The one-touch doorlock device in accordance with claim 1, wherein the lock state sensing means comprises:

a rotating cam fixedly mounted on a rotating shaft operatively connected to the key unit to move the locking bolt of the lock unit, the rotating cam having a fixing protrusion, a guide portion and a pushing protrusion;

an actuating member adapted to move vertically by a guide operation of the rotating cam, the actuating member having a guide slot;

a locking pin slidably received in the guide slot of the actuating member;

a fixing hole provided at the actuating member for selectively engaging the fixing protrusion therein; and a pair of switch members provided at the actuating member to activate a lock/unlock sensing switch for sensing a locked/unlocked state of the locking bolt and a cut-off switch for selectively cutting off power from the power supply means when the locking bolt is in its unlocked state, respectively.

* * * * *